US011686174B2

(12) United States Patent
Arabie et al.

(10) Patent No.: US 11,686,174 B2
(45) Date of Patent: Jun. 27, 2023

(54) STORM PACKER ANCHOR AND SETTING TOOL

(71) Applicant: Frank's International, LLC, Houston, TX (US)

(72) Inventors: Blake Arabie, Rayne, LA (US); Robert Taylor, Houston, TX (US); Scotty Verret, Carencro, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 196 days.

(21) Appl. No.: 17/344,190

(22) Filed: Jun. 10, 2021

(65) Prior Publication Data

US 2022/0397013 A1 Dec. 15, 2022

(51) Int. Cl.

| | |
|---|---|
| ***E21B 23/06*** | (2006.01) |
| ***E21B 33/128*** | (2006.01) |
| ***E21B 33/129*** | (2006.01) |

(52) U.S. Cl.
CPC ..... *E21B 33/128* (2013.01); *E21B 23/06* (2013.01); *E21B 33/1292* (2013.01)

(58) Field of Classification Search
CPC ..... E21B 23/06; E21B 33/128; E21B 33/1292
See application file for complete search history.

(56) References Cited

U.S. PATENT DOCUMENTS

| | | | |
|---|---|---|---|
| 3,361,207 | A | 1/1968 | Chenoweth |
| 3,433,301 | A | 3/1969 | McEver, Jr. |
| 3,508,610 | A | 4/1970 | Kisling, III |
| 3,516,493 | A | 6/1970 | McGill |
| 3,552,492 | A | 1/1971 | Mullins |
| 3,797,572 | A | 3/1974 | Mignotte |

(Continued)

FOREIGN PATENT DOCUMENTS

| | | | | |
|---|---|---|---|---|
| EP | 0928879 | A2 * | 7/1999 | ..... E21B 33/1295 |
| GB | 1192795 | A | 5/1970 | |

(Continued)

OTHER PUBLICATIONS

Baker Hughes, Model GT™ Lok-Set® Retrievable Bridge Plug Product Family No. H67737, Baker Oil Tools, 2002, 2 pages.

(Continued)

*Primary Examiner* — Cathleen R Hutchins
*Assistant Examiner* — Ronald R Runyan
(74) *Attorney, Agent, or Firm* — MH2 Technology Law Group LLP

(57) ABSTRACT

An anchor-packer assembly includes a packer having a slips assembly and a seal. The slips assembly and the seal are radially expandable so as to engage a surrounding tubular. The assembly also includes an anchor coupled to the packer. The anchor includes a slips assembly and is configured to transmit a first torque and a first axial force to the packer, to set the packer. The anchor is configured to be actuated from an anchor running position in which the slips assembly thereof is retracted, to an anchor set position, in which the slips assembly thereof is expanded radially outward, in response to a second torque and a second axial force, and the anchor in the anchor set position is configured to prevent an uphole-directed force on the packer from releasing the slips assembly of the packer from engagement with the surrounding tubular.

20 Claims, 8 Drawing Sheets

(56) References Cited

U.S. PATENT DOCUMENTS

| | | | | |
|---|---|---|---|---|
| 3,804,164 | A * | 4/1974 | Ellis | E21B 33/1291 166/134 |
| 4,078,606 | A | 3/1978 | Montgomery | |
| 4,156,460 | A * | 5/1979 | Crowe | E21B 33/1293 166/134 |
| 4,928,762 | A | 5/1990 | Mamke | |
| 4,930,573 | A | 6/1990 | Lane et al. | |
| 5,046,557 | A | 9/1991 | Manderscheid | |
| 5,697,449 | A * | 12/1997 | Hennig | E21B 33/1294 166/330 |
| 8,276,677 | B2 | 10/2012 | Ravensbergen | |
| 2010/0243254 | A1 | 9/2010 | Murphy et al. | |
| 2019/0284898 | A1 | 9/2019 | Fagna et al. | |

FOREIGN PATENT DOCUMENTS

| | | |
|---|---|---|
| GB | 2164375 A | 3/1986 |
| GB | 2581268 A | 8/2020 |

OTHER PUBLICATIONS

Schlumberger, SIMultra Retrievable bridge plug, Schlumberger, slb.com/SIMultra, 4 pages.

Peak Well Systems, SIMultra Retrievable Bridge Plug, Peak Well Systems, 1 page.

Schlumberger, SIMultra retrievable bridge plug, slb.com/SIMultra, 2020, 1 page.

Schlumberger, SIMultra Retrievable bridge plug, https://www.slb.com/well-intervention/slickline-and-wireline-intervention/slickline-mech . . . , Nov. 12, 2020, 7 pages.

Archer, Lock® Gas tight plugs, https://www.archerwell.com/products-services/oiltools/plugs/lock/, Nov. 12, 2020, 6 pages.

Archer, New Temporary Abandonment Method Proves to be Company Standard by Reducing Risks and Saving Multiple Rig Days upwards of Several Million Dollars, Archer, archerwell.com, 2018, 1 page.

Archer, Archer LOCK® series 2015—YouTube, https://www.youtube.com/watch?reload=9&v=VFkjQ6THhiw, Nov. 12, 2020, 7 pages.

Halliburton, Interceipt® Retrievable Bridge Plug, https://halliburton.com/en-US/ps/senrice-tools/retrievable-packers-tools/Intercept-B . . . , Nov. 12, 2020, 2 pages.

Omega Well Intervention, V-Zero™ Retrievable Bridge Plug, Omega Well Intervention Ltd, Jan. 29, 2019, 2 pages.

Omega Well Intervention, Gemini Retrievable Bridge Plug, Omega Well Intervention Ltd, Feb. 25, 2020, 2 pages.

Extended European Search Report dated Nov. 7, 2022, EP Application No. 22178215, 5 pages.

* cited by examiner

STORM PACKER ANCHOR AND SETTING TOOL

BACKGROUND

Packers are downhole tools used in the oilfield to isolate one wellbore region from another. Generally, the packers are lowered and set in the well using a drill pipe string. Once the packer is set, the landing string is released from the packer and the landing string is then withdrawn. There are a variety of different types of packers. One specific type of packer is a storm packer. Storm packers are typically used in offshore drilling to pack off an upper section of a well from a lower section, while supporting a drill string ("tailpipe") extending farther down into the well. By contrast, most retrievable packers/plugs are not configured to support a tailpipe. Using the storm packer, when inclement weather (hence the name "storm packer") is approaching, or it is otherwise desirable to temporarily abandon a well, the well can be plugged and surface equipment moved without pulling the entire drill string from the well. In at least some jurisdictions, regulatory authorities may require offshore drilling rigs to have a storm packer available for such situations.

Since they are often required, storm packers may be readily available on drilling rigs. However, storm packers are generally of limited use outside of the context of temporarily abandoning a well. For example, storm packers are generally not considered a substitute for retrievable packers/plugs because storm packers rely on the suspended weight of the tailpipe to remain anchored in place. Without this weight, storm packers may be prone to release, e.g., in the presence of a transient upward pressure differential. Thus, the storm packers are usually not in use during most rig operations; however, since storm packers are often rented by rig operators to satisfy the regulatory requirements, a cost is thus incurred for the storm packer while it is not being used.

SUMMARY

Embodiments of the disclosure include an anchor-packer assembly that includes a packer having a slips assembly and a seal. The slips assembly and the seal are radially expandable so as to engage a surrounding tubular. The assembly includes an anchor coupled to the packer. The anchor includes a slips assembly and is configured to transmit a first torque and a first axial force to the packer, to set the packer. The anchor is configured to be actuated from an anchor running position in which the slips assembly thereof is retracted, to an anchor set position, in which the slips assembly thereof is expanded radially outward, in response to a second torque and a second axial force, and the anchor in the anchor set position is configured to prevent an uphole-directed force on the packer from releasing the slips assembly of the packer from engagement with the surrounding tubular.

Embodiments of the disclosure also include an anchor for a storm packer. The anchor includes a torque mandrel configured to connect to a packer mandrel of the storm packer and configured to transmit torque and axial forces thereto, an inner mandrel positioned at least partially within the torque mandrel, and a clutch coupled to the inner mandrel and the torque mandrel. The clutch is configured to transmit torque between the inner mandrel and the torque mandrel up to a predetermined amount of torque, and to permit relative rotation therebetween at a torque above the predetermined amount of torque. The storm packer in a running position is rotatable by rotating the torque mandrel in a first rotational direction. The anchor includes a slips assembly positioned around the inner mandrel and extendable radially outward by moving the inner mandrel in a first axial direction relative to the torque mandrel, and a locking mechanism to selectively couple the torque mandrel to the inner mandrel, the locking mechanism having a first locked condition that permits the inner mandrel to rotate relative to the torque mandrel, and prevents the inner mandrel from moving in a first axial direction relative to the torque mandrel, an unlocked condition that permits the inner mandrel to move in the first axial direction and a second axial direction relative to the torque mandrel so as to extend and retract the slips assembly, and a second locked condition that permits the inner mandrel to rotate relative to the torque mandrel, and prevents the inner mandrel from moving in the second axial direction relative to the torque mandrel. The locking mechanism is configured to be actuated from the first locked condition to the unlocked condition by rotating the inner mandrel in the first rotational direction relative to the torque mandrel at a torque that is above the predetermined amount of torque.

Embodiments of the disclosure also include a method for setting a packer that includes connecting an anchor to the packer so as to form at least a portion of a packer assembly, deploying the packer assembly into a well, rotating a packer mandrel of the packer in a first rotational direction by rotating an inner mandrel of the anchor in the first rotational direction, after rotating the packer mandrel, setting slips of the packer in a surrounding tubular by moving the anchor in a first axial direction, after setting the packer, rotating the inner mandrel relative to a torque mandrel of the anchor to release a locking mechanism, the torque mandrel being prevented from rotating along with the inner mandrel by connection to the packer mandrel, and after rotating the inner mandrel, setting slips of the anchor by moving the inner mandrel in the first axial direction relative to the torque mandrel. Moving the inner mandrel in the first axial direction locks the locking mechanism, such that the torque mandrel is prevented from moving in a second axial direction relative to the inner mandrel. The inner mandrel is prevented from moving in the second axial direction by the slips of the anchor.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
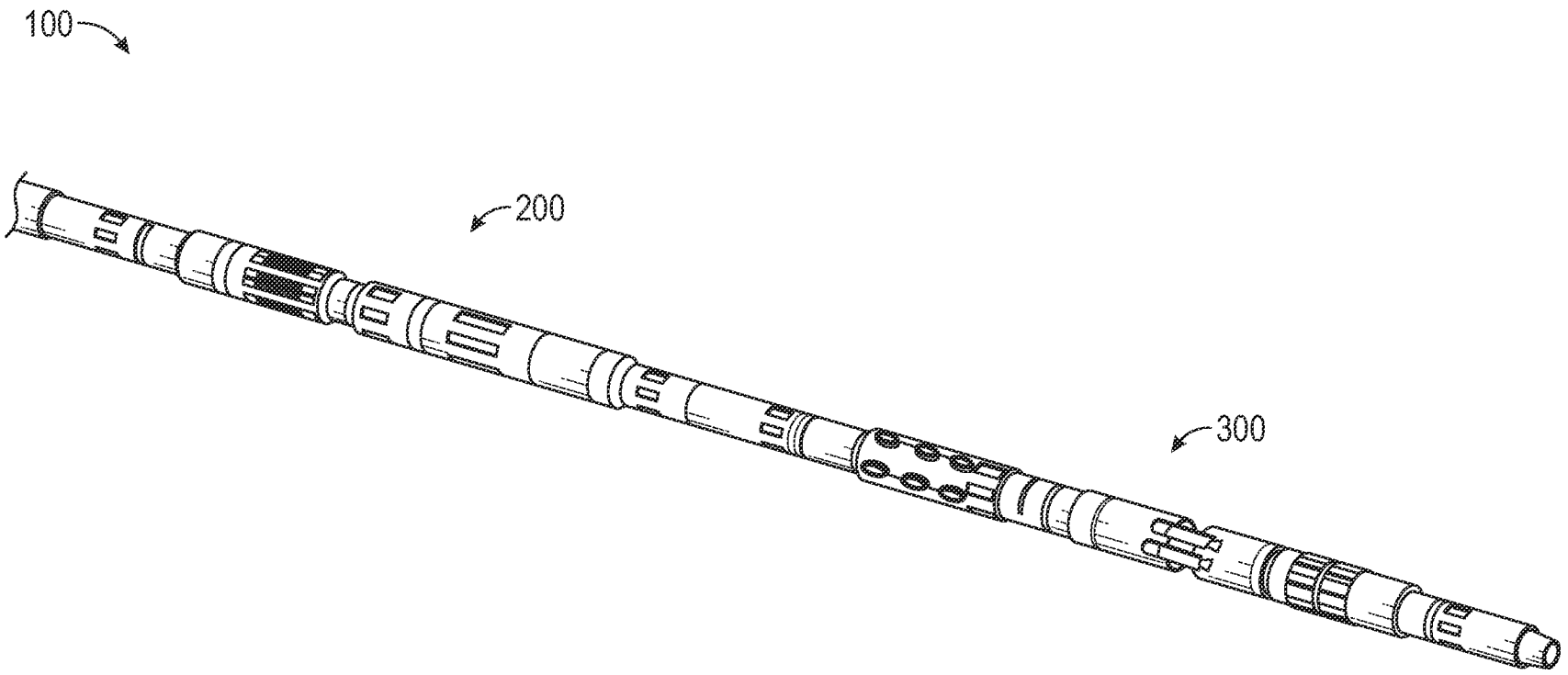
FIG. 1 illustrates a perspective view of a packer assembly, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

FIG. 1 illustrates a perspective view of an anchor-anchor-packer assembly 100, according to an embodiment. The anchor-packer assembly 100 generally includes an anchor 200 and a packer 300. The packer 300 may be a "storm" packer, which may be designed to connect to a tailpipe that extends in a downhole direction therefrom. The packer 300 may thus be configured to rely on the weight of the tailpipe to remain in a set position (also referred to herein as a "packer set" position), in which the slips of the packer 300 are extended and anchored into a surrounding tubular, as will be described in greater detail below. In an embodiment, such a tailpipe may not be provided, and instead the anchor 200 may be connected to an upper end of the packer 300. The anchor 200 may be coupled to a landing string extending from the surface, such that the landing string is able to manipulate the packer 300 (e.g., set the packer 300) via the anchor 200. Further, the landing string may be used to set the anchor 200, which in turn serves to lock the packer 300 in the packer set position. Since the anchor 200 is configured to lock the packer 300 in the packer set position, the anchor 200 may be free from sealing elements configured to seal with a surrounding tubular. In other embodiments, the anchor 200 may include such seals. Once the packer 300 and anchor 200 are set in the wellbore the landing string is disconnected from the anchor 200 and may be removed from the wellbore.

Figure 2:
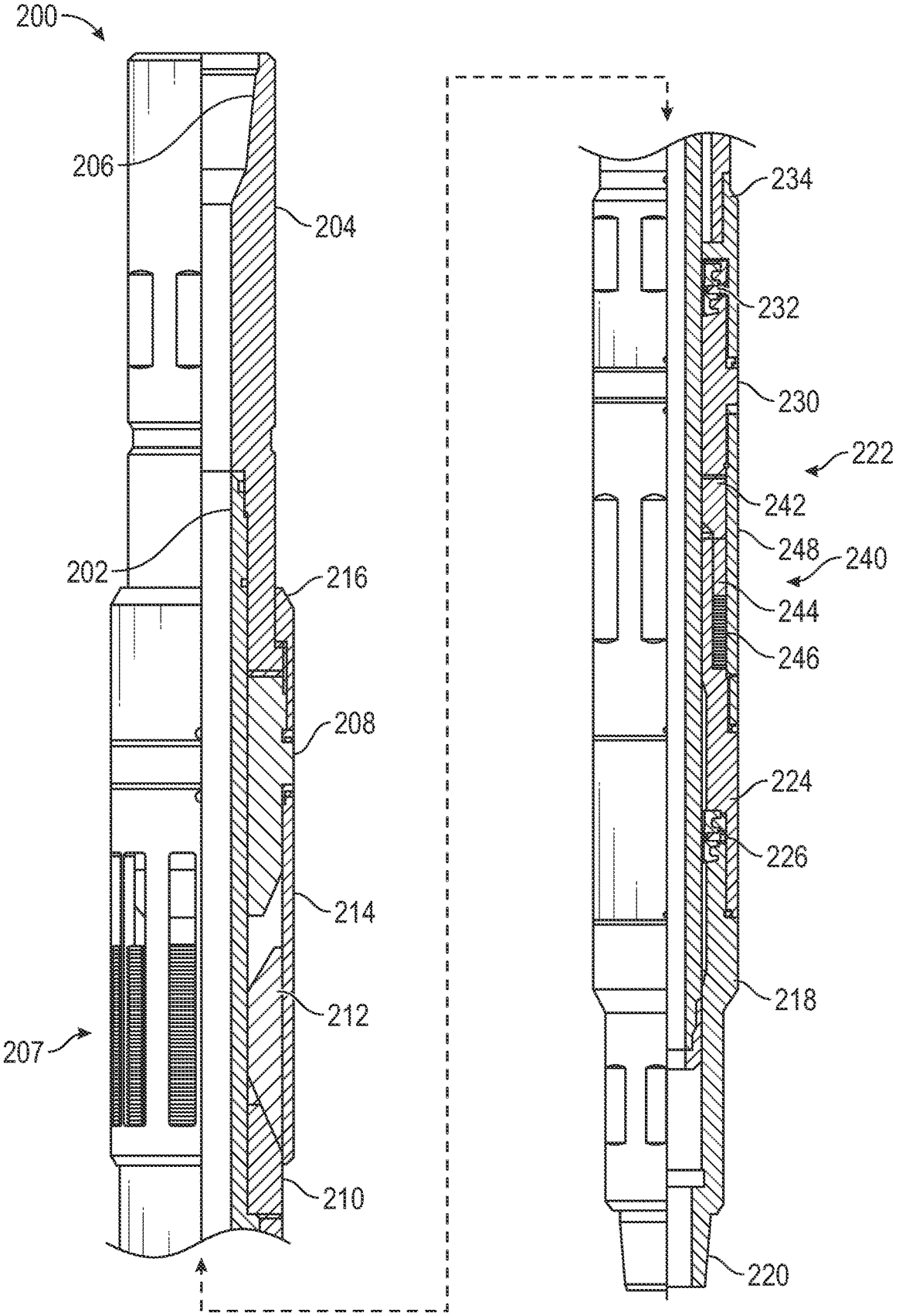
FIG. 2 illustrates a side, half-sectional view of an anchor for the packer assembly, according to an embodiment.

FIG. 2 illustrates a side, half-sectional view of the anchor 200, with the anchor components in position for running the anchor into the wellbore, i.e., in an anchor running position, according to an embodiment. As shown, the anchor 200 may include an inner mandrel 202, which may be one or more hollow, generally cylindrical members about which one or more other components may be positioned. An upper sub 204 may be coupled to the inner mandrel 202. The upper sub 204 may include an upper connection 206, which may be a threaded female or "box end" connection for connecting to a tubular string extending from the surface. The upper sub 204 may be positioned around and connected to an upper portion of the inner mandrel 202. For example, the upper sub 204 may be threaded onto the inner mandrel 202, such that the upper sub 204 and the inner mandrel 202 are movable together, e.g., non-movable relative to one another unless the connection therebetween is released.

A slips assembly 207 may also be positioned around the inner mandrel 202. The slips assembly 207 may include a first cone 208, a second cone 210, and one or more slips 212. The slips assembly 207 may also include a cage 214 that connects to and extends between the first and second cones 208, 210. The cage 214 also extends over the slips 212 and provides windows through which the slips 212 may extend radially outward. The slips 212 may be driven radially outward by moving the cones 208, 210 axially closer together, e.g., by moving one or both cones 208, 210 relative to the inner mandrel 202 and the slips 212.

In an embodiment, the first cone 208 may be positioned axially against an end of the upper sub 204. A cover 216 may be provided over an interface between first cone 208 and the upper sub 204 and may be secured against movement in at least one direction by connection to the upper sub 204. The first cone 208 may be prevented from moving relative to the inner mandrel 202 via engagement with the upper sub 204 and the cover 216 and/or by direct fastening thereof to the inner mandrel 202. In the illustrated anchor running position, the slips 212 are retracted radially inward, and are held generally within the cage 214, near the inner mandrel 202. Upon actuation to an anchor set position the slips 212 may extend radially outwards so as to engage with and anchor in a surrounding tubular.

The anchor 200 also includes a lower sub 218 that is received around a lower portion of the inner mandrel 202. The lower sub 218 may not be secured directly to the inner mandrel 202; rather, the inner mandrel 202 may be configured to rotate and/or axially translate relative to the lower sub 218 so as to actuate the anchor 200. The lower sub 218 may also provide a lower connection 220, which may be a threaded, male "pin end" connection that is configured to be connected directly to the packer 300. Thus, the connection between the lower sub 218 and the packer 300 may be configured to transmit axial loads and torque therebetween, which may permit the anchor 200 not only to set the packer 300 in the well, but also to use the packer 300 to set the anchor 200, as will be described in greater detail below.

The anchor 200 also includes a torque mandrel 224 that is secured to the lower sub 218 such that the torque mandrel 224 and the lower sub 218 are not rotatable or axially movable relative to one another. For example, the torque mandrel 224 may be threaded, fastened, or otherwise secured to the lower sub 218. In some embodiments, the torque mandrel 224 may be integral to the lower sub 218.

A setting control assembly 222 may be positioned between the upper sub 204 and the lower sub 218. The setting control assembly 222 may be configured to selectively transfer torque, applied at the upper sub 204 to the lower sub 218, and to the packer 300, to facilitate rotating a portion of the packer 300 to unlock and set the slips thereof, as will be described in greater detail below. Once the packer slips are set, the setting control assembly 222 may allow for differential rotation of the upper sub 204 and inner mandrel 202 relative to the lower sub 218 of the anchor 200 and the packer 300, which may permit selectively setting the anchor 200 in the well.

In an embodiment, the setting control assembly 222 includes a lower lock ring 226 that may be positioned in a groove formed between the inner shoulders of the torque mandrel 224 and the lower sub 218 when the outer shoulders of the torque mandrel 224 and lower sub 218 are abutted against each other. For example, as shown, the torque mandrel 224 may overlap the lower sub 218, such that the torque mandrel 224 not only axially abuts the lower lock ring 226, but also extends over and entrains the lower lock ring 226 radially between the torque mandrel 224 and the inner mandrel 202. When the anchor 200 is in the set position, the lower lock ring 226 engages threads of the inner mandrel 202, as will be described in greater detail below. Axial movement of the inner mandrel 202 in at least one axial direction (e.g., both directions) relative to the lower lock ring 226 is prevented (e.g., only rotation is permitted) while the anchor 200 is in the running position by engagement between the upper lock ring 232 and mating threads on the inner mandrel 202. In the illustrated anchor running position, the lower lock ring 226 may not engage threads of the inner mandrel 202, but may be axially offset therefrom, which permits such sliding axial movement required to set the anchor in the wellbore.

The setting control assembly 222 may further include a clutch connector 230 which may be received around the inner mandrel 202. The clutch connector 230 may be rotationally secured to the inner mandrel 202, such that the clutch connector 230 is constrained from rotating with respect thereto. The connection between the clutch connector 230 and the inner mandrel 202 may, however, permit the inner mandrel 202 to slide or "shift" axially by a distance with respect to the clutch connector 230. For example, the clutch connector 230 may be secured to the inner mandrel 202 via one or more keys, pins, blocks, etc., which may be received into corresponding axially-extending grooves (not visible in this view) formed in the inner mandrel 202. Additionally or alternatively, the keys, blocks, etc., may be formed in or connected to the inner mandrel 202 and received into corresponding grooves in the clutch connector 230. Since the inner mandrel 202 and the clutch connector 230 are rotationally locked together, torque applied to the inner mandrel 202 (via the upper sub 204) is transmitted to the clutch connector 230.

An upper lock ring 232 of the setting control assembly 222 may be disposed axially adjacent to at least a portion of the clutch connector 230. Like the lower lock ring 226, the upper lock ring 232 may be configured to engage an upper set of threads formed in the inner mandrel 202. Further, a cone connector 234 may be coupled with the clutch connector 230, which may entrain the upper lock ring 232 axially within a groove formed between the cone connector 234 and the clutch connector 230, and radially between the inner mandrel 202 and the cone connector 234. In the illustrated anchor running position, the upper lock ring 232 may engage threads of the inner mandrel 202, such that the inner mandrel 202 is prevented from sliding relative to the clutch connector 230 in at least one axial direction. Accordingly, the combination of the lock rings 226, 232 and the components that interact therewith in the anchor 200 form an embodiment of a "locking mechanism", as they may be configured to selectively restrain the anchor 200. In other embodiments, one or more of these components may be omitted or other components added in order to perform the function of the locking mechanism. In this embodiment, the upper lock ring 232 restrains the anchor 200 in the running position, and the lower lock ring 226 restrains the anchor 200 in the set position, as will be described in greater detail below. Additionally, the term "selectively" refers to something done at the selection of the designer and/or the operator, and not conducted incidentally. For example, the locking mechanism may "selectively" restrain (or permit movement of) the anchor 200 depending on the operations conducted by the intentional operations of the operator.

The setting control assembly 222 may also include a clutch 240, which may be configured to selectively prevent or permit relative rotation between the inner mandrel 202 and the components positioned around the inner mandrel 202 that are non-rotatable relative to the lower sub 218. For example, the clutch 240 may prevent rotation between the inner mandrel 202 and the torque mandrel 224, unless a predetermined amount of torque is applied. When the packer 300 is not set, this predetermined amount of torque may not be experienced, because the packer 300 may be generally permitted to rotate in the wellbore, as will be described in greater detail below. In other words, rotating the inner mandrel 202 may cause the lower sub 218 that is connected to the packer 300 to rotate unless there is a resistance to such rotation that requires at least a predetermined amount of torque to overcome. When such resistance is present, the clutch 240 does not transmit additional torque, but instead permits the inner mandrel 202 to rotate relative to the lower sub 218 (and the packer 300).

In an embodiment, the clutch 240 includes an upper clutch jaw 242 that is coupled to the clutch connector 230 and rotationally locked to the inner mandrel 202. The clutch 240 also includes a lower clutch jaw 244 that meshes with the upper clutch jaw 242 and is rotationally locked to the torque mandrel 224, which is in turn rotationally locked to the lower sub 218. The upper and lower clutch jaws 242, 244 are biased into engagement by a biasing member 246, e.g., a spring. In the illustrated embodiment, the biasing member 246 is positioned axially between the torque mandrel 224 and the lower clutch jaw 244, thereby biasing the lower clutch jaw 244 into torque-transmitting connection with the upper clutch jaw 242; however, it will be appreciated that the biasing member 246 could be configured to apply a biasing force on the upper clutch jaw 242. A clutch cover 248 may extend between the torque mandrel 224 and the clutch connector 230 and may cover the upper and lower clutch jaws 242, 244 and the biasing members 246, while permitting relative rotation of the clutch connector 230 and the torque mandrel 224.

Figure 3:
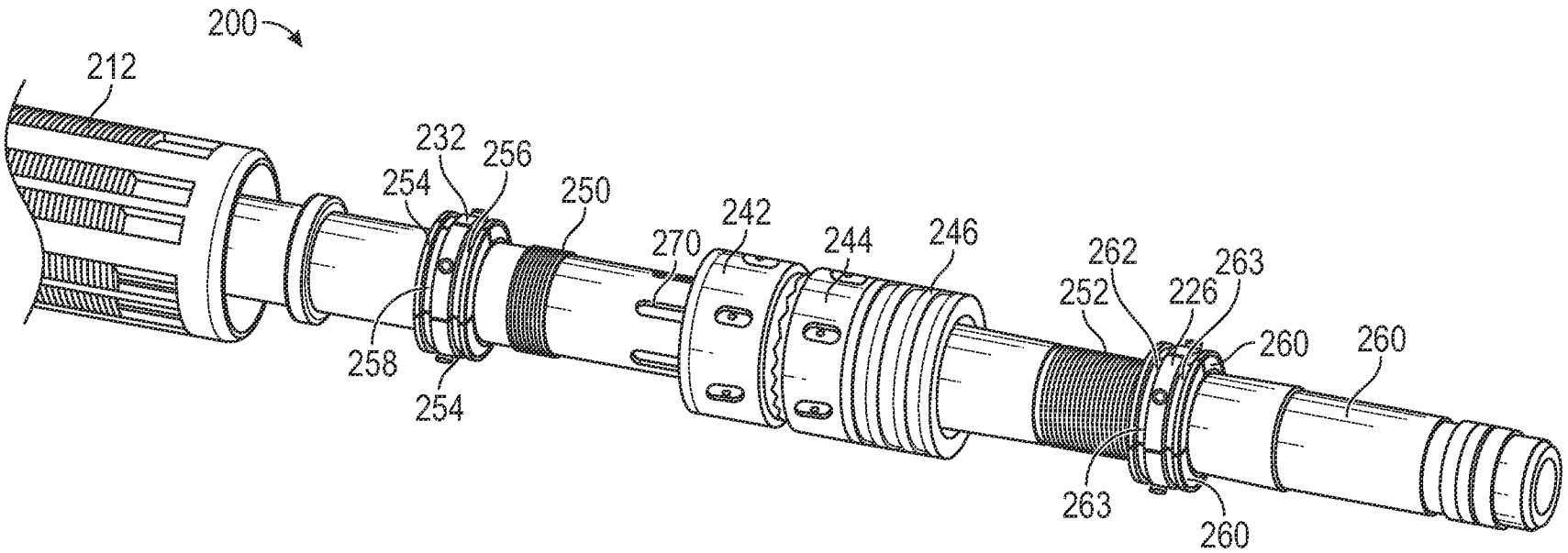
FIG. 3 illustrates a perspective view of a setting control assembly of the anchor, according to an embodiment.

FIG. 3 illustrates a perspective view of a portion of the anchor 200, with several outer components omitted for purposes of discussion, according to an embodiment. In comparison to FIG. 2, FIG. 3 shows the mandrel 202 after it has been translated axially downward relative to the lower sub 218, such that the position of the mandrel 202 now corresponds to the point where the lower threads 252 of the inner mandrel 202 are beginning to engage the threads of the segmented lower lock ring 226. With the downward movement of the inner mandrel 202 relative to the lower sub 218, torque mandrel 224, and lower cone, the slips 212 are beginning to be urged radially outward until the anchor 200 reaches a fully set, "anchor set" position in which the slips 212 engage and anchor in the surrounding tubular.

The inner mandrel 202 has upper threads 250 and lower threads 252. The upper and lower threads 250, 252 may be configured to be threaded into the upper and lower lock rings 232, 226 respectively, by rotating the inner mandrel 202 relative thereto. Further, as shown, the upper lock ring 232 may be formed from a plurality of arcuate segments 254, which may be held together, end-to-end to form an annular structure that extends around the inner mandrel 202. The arcuate segments 254 may be held together via one or more springs, which may be received into circumferential grooves 256, 258 formed in the segments 254. The lower lock ring 226 may be similarly formed from segments 260, with springs received into grooves 262, 263 holding the segments 260 together around the inner mandrel 202. Accordingly, the thread form on the lock rings 232, 226 and inner mandrel 202 may be configured to allow for "jumping" the respective threads 250, 252, as the segments 254, 260 thereof separate apart, such that each permits axial sliding (i.e., without requiring rotation) movement of the inner mandrel 202 in one axial direction. In an embodiment, the lock rings 232, 226 may be configured to permit axial movement of the inner mandrel 202 in opposite directions, while each resists movement in the opposite direction, when engaged with the threads 250 or 252. The helical orientation of the threads 250, 252 may also be reversed, such that selective rotation of the inner mandrel 202 in the same rotational direction (e.g., right-hand rotation) causes the lock rings 232, 226 to disengage from the threads 250, 252 in opposite axial directions.

Figure 4A:
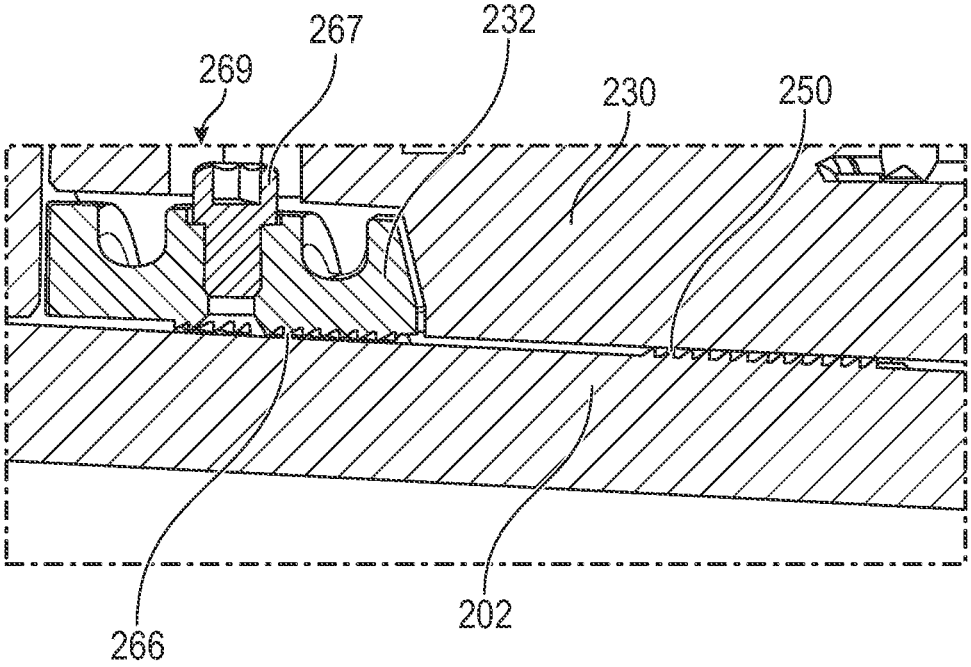
FIG. 4A illustrates a side, cross-sectional view of an upper lock ring of the setting control assembly, according to an embodiment.

FIG. 4A illustrates an enlarged cross-sectional view of the upper lock ring 232 received around the inner mandrel 202, according to an embodiment. As shown, the upper lock ring 232 is axially offset from the upper threads 250, and thus the upper lock ring 232, in this configuration, does not prevent axial movement of the inner mandrel 202 relative to the upper lock ring 232. Threads 266 on the upper lock ring 232 may be tapered at an angle, and the upper threads 250 may be similarly tapered. Thus, given the segmented and spring-loaded construction of the upper lock ring 232, when the threads 266 and the upper threads 250 are meshed, the threads 266, 250 may permit the inner mandrel 202 to slide axially in the uphole direction (to the left, in this view), while preventing axial movement of the inner mandrel 202 in the downhole direction. Further, when meshed, the threads 250, 266 may permit rotation of the inner mandrel 202, e.g., as a screw connection. The upper lock ring 232 may also receive a bolt 267 therein, which may be configured to engage a hole 269 of the cone connector 234, which may thus prevent the upper lock ring 232 from rotating with the inner mandrel 202.

When the anchor 202 is released from the set position in the wellbore the upper sub 204 and inner mandrel 202 are lowered relative to the clutch connector 230, torque mandrel 224 and lower sub 218. As the inner mandrel 202 is lowered, the segments of the upper lock ring 232 are ratcheted radially outward over the upper threads 250 without rotation of either the inner mandrel and the upper lock ring 232. The anchor 200 is retained in the running position by way of reengagement between the upper threads 250 and the upper lock ring 232. This action resets the anchor 200 to the running position, which allows the anchor and anchor-packer assembly 100 to be withdrawn from the wellbore.

Figure 4B:
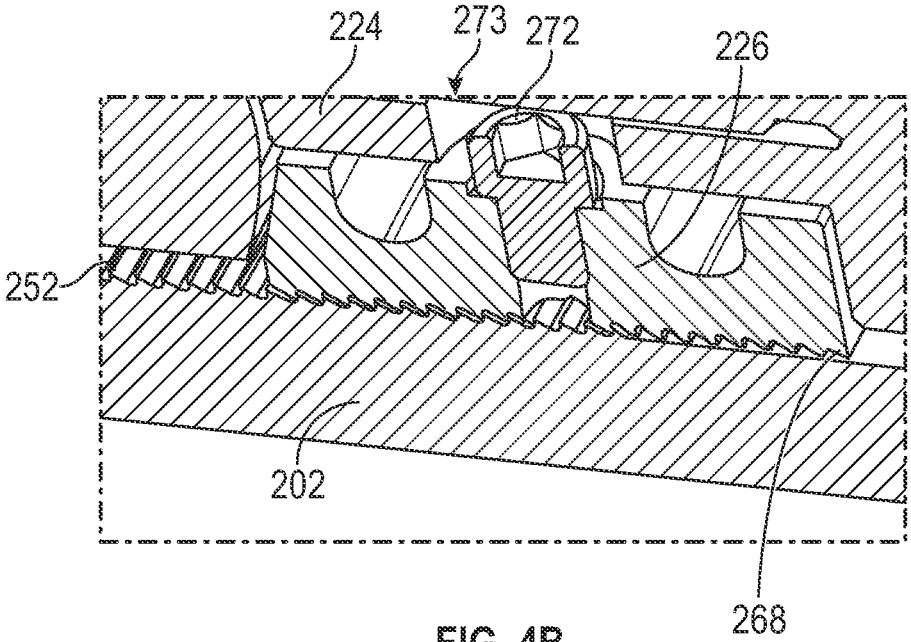
FIG. 4B illustrates a side, cross-sectional view of a lower lock ring of the setting control assembly, according to an embodiment.

FIG. 4B similarly illustrates an enlarged cross-sectional view of the lower lock ring 226, according to an embodiment. As shown, the lower lock ring 226 includes tapered threads 268 that are meshed with the lower threads 252 of the inner mandrel 202. The threads 252, 268 are tapered, e.g., in a reverse orientation as the threads 250, 266, discussed above, and thus prevent axial movement of the inner mandrel 202 in the second axial (uphole) direction, i.e., the same direction that the threads 250, 266 are configured to permit. Moreover, the threads 252, 268 may permit axial movement of the inner mandrel 202 in the first axial (downhole) direction relative to the clutch connector 230, torque mandrel 224, and lower sub 218 without the need to rotate either of the inner mandrel 202 or the lower lock ring 218. The combination of the tapered thread form and the segmented construction of the lower lock ring 218 permits the inner mandrel 202 to move downward relative to the lower lock ring 218 and in doing so the segments of the lower lock ring 218 move radially outward allowing the inner mandrel 202 to ratchet downward relative to the lower lock ring 218. The lower lock ring 226 may also include a bolt 272 that is received through and configured to engage a hole 273 of the torque mandrel 224, so as to prevent the lower lock ring 226 from rotating relative to the torque mandrel 224, and thus permitting the inner mandrel 202 to be rotated relative to the lower lock ring 226.

It will be appreciated that the positioning of the lower lock ring 232 may be swapped with the upper lock ring 232, along with swapping the orientation of the threads 250, 252, without departing from the scope of the present disclosure. Moreover, the upper and lower lock rings 226, 232 may be on a same axial side of the clutch 240. In other embodiments, other connections that permit rotation but control (e.g., selectively permit and block) axial translation of the inner mandrel 202 may be employed.

Figure 5:
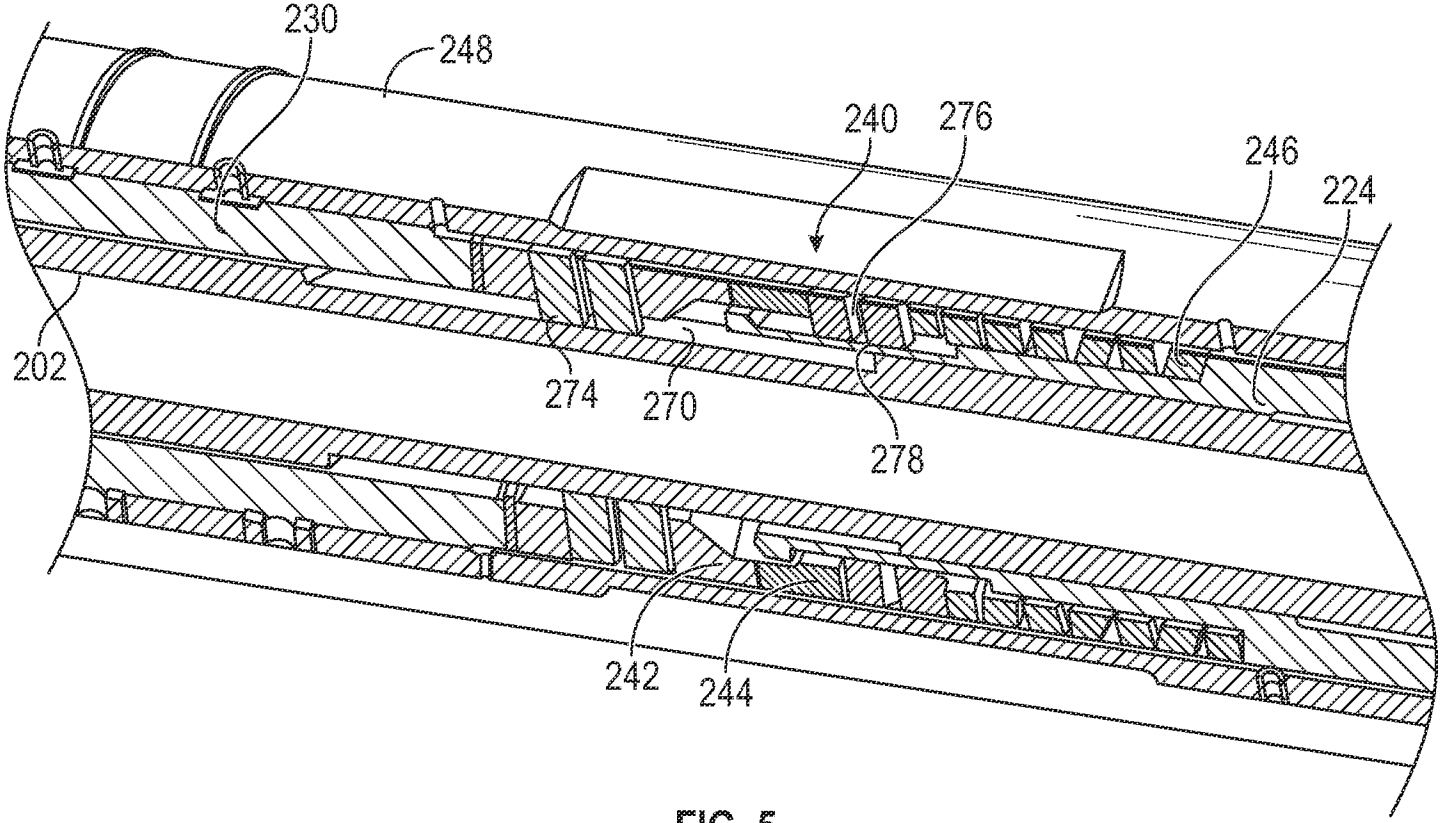
FIG. 5 illustrates a side, cross-sectional view of a clutch of the setting control assembly, according to an embodiment.

Referring again to FIG. 3, axially-extending grooves 270 are formed in the inner mandrel 202. As noted above, these grooves 270 may form one half of a torque-transmitting connection between the inner mandrel 202 and the upper clutch jaw 242 (e.g., via the clutch connector 230, which is omitted from view in this figure). FIG. 5 illustrates an enlarged sectional view of a portion of the setting control assembly 222, according to an embodiment. In particular, this view shows torque blocks 274 received through the upper clutch jaw 242 and torque blocks 276 received through the lower clutch jaw 244. The torque blocks 274 may be received into the grooves 270 formed in the inner mandrel 202, thereby forming a torque transmitting connection between the upper clutch jaw 242 and the inner mandrel 202. Further, this torque transmitting connection does not prevent the inner mandrel 202 from sliding in an axial direction, at least for a certain range of motion, as defined by the axial length of the grooves 270. Similarly, the torque blocks 276 may be received into grooves 278 formed in the torque mandrel 224, forming a torque transmitting connection between the torque mandrel 224 and the lower clutch jaw 244. This torque-transmitting connection may permit reciprocating axial movement of the lower clutch jaw 244 relative to the first gear 242.

Accordingly, teeth of the lower clutch jaw 244 may be permitted to momentarily back out of engagement with complementary wedge-shaped teeth of the upper clutch jaw 242, by application of a torque from the inner mandrel 202 to the upper clutch jaw 242 that is above a predetermined amount of torque (e.g., predetermined torque threshold). This clutch arrangement allows torque below the predetermined torque threshold to be transmitted from the inner mandrel 202 and upper clutch jaw 242 to the lower clutch jaw 244, torque mandrel 224, the lower sub 218 and the packer 300 below. Once the packer 300 is set and rotationally secured into engagement with the wellbore the upper sub 204, clutch connector 230, and inner mandrel 202 are allowed to rotate relative to the torque mandrel 224 and lower sub 218 via the ratcheting action of the lower clutch jaw 242. It will be appreciated that other clutch 240 designs, configured to transmit torque up to a certain predetermined torque setting may be employed, without departing from the scope of the present disclosure.

Figure 6:
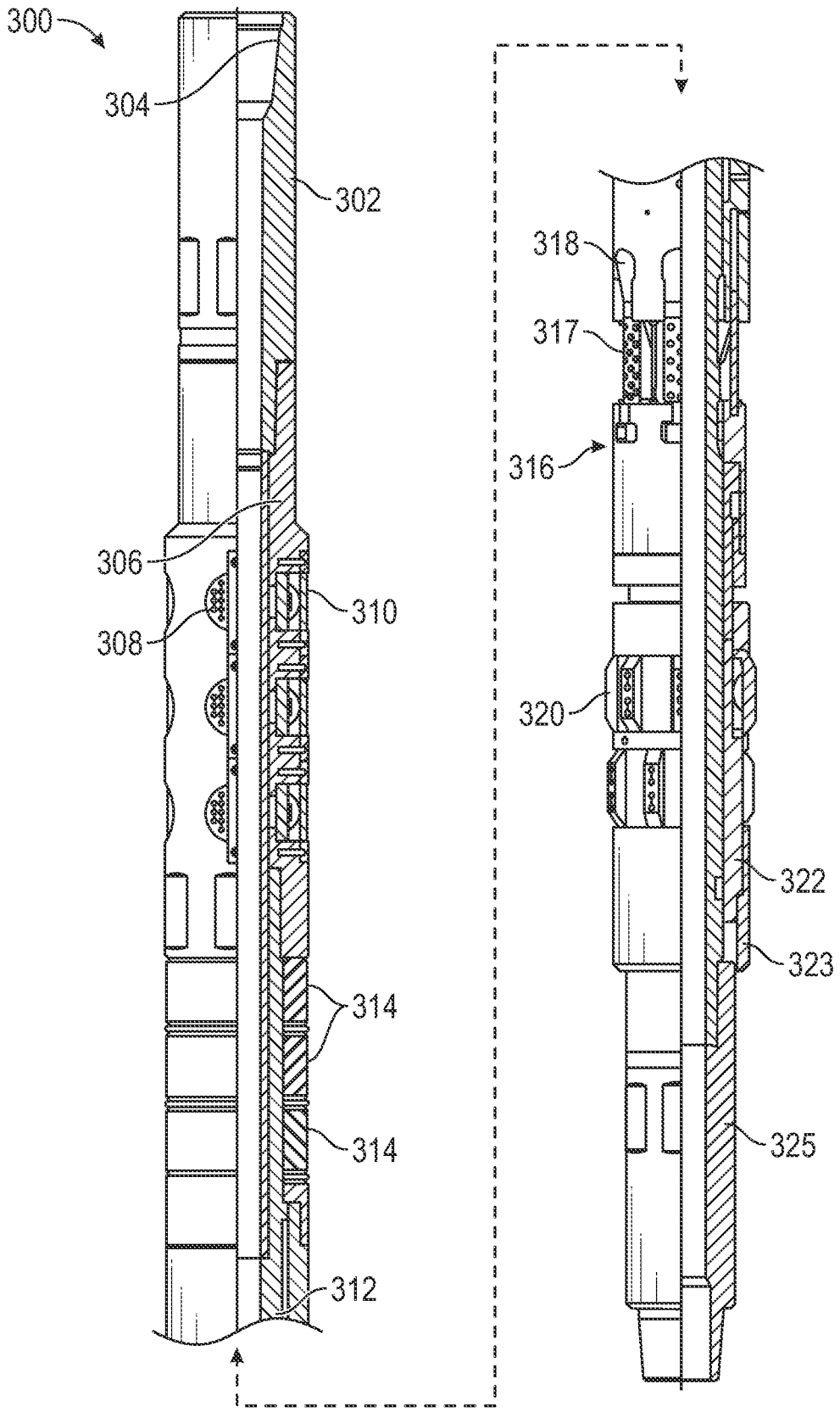
FIG. 6 illustrates a side, half-sectional view of a packer of the packer assembly, according to an embodiment.

FIG. 6 illustrates a perspective view of the packer 300 in the packer running position, according to an embodiment. The packer 300 may include an upper sub 302, which may provide an upper connection 304 that connects to the lower connection 220 of the anchor 200, as discussed above. Accordingly, torque and/or axial loads may be applied to the packer 300 via the connection with the lower sub 218 of the anchor 200 (FIG. 2). In particular, torque and/or axial forces may be applied to the packer mandrel 312 via the inner mandrel 202, the torque mandrel 224, and the lower sub 218.

The packer 300 may further include a hold down mandrel 306, including hold down buttons 308 and straps 310, which will be described in greater detail below. A packer mandrel 312 may extend from the hold down mandrel 306, and may be coupled thereto such that the packer mandrel 312 rotates with the mandrel 306, which is rotated by torque applied to the upper sub 302. The torque mandrel 224 (FIG. 2) may be considered to be coupled to the packer mandrel via the lower sub 218 and the upper sub 302. The packer mandrel 312 may be made up of several different, e.g., special-purpose, cylindrical members (e.g., various inner mandrels, J-slot mandrels, etc.), that may be threaded, pinned, or otherwise connected together, potentially via other components. In some embodiments, the packer mandrel 312 may be a single, monolithic structure. Elastomeric seals 314 may be positioned around the packer mandrel 312. The seals 314 may be configured to expand radially outward when axially compressed during setting. The seals 314 may thus be configured to form a fluid-tight seal with a surrounding tubular.

A slips assembly 316 may also be positioned around the packer mandrel 312. The slips assembly 316 may include a plurality of (e.g., unidirectional) slips 317, which may, on one axial side, engage a tapered cone 318. Thus, when the slips assembly 316 is axially compressed, e.g., by pressing or allowing the packer mandrel 312 to move downwards with respect thereto, the slips assembly 316 may expand radially outward by driving the cone 318 downward relative to slips 317.

Once the slips 317 are anchored into the surrounding tubular, and the sealing element 314 is in sealing position (the packer 300 is set), the hold down buttons 308 are hydraulically pressed radially outward into a gripping engagement with the surrounding tubular when a differential between the pressure from below the packer 300 is greater than the pressure from above the packer 300. The hold down buttons 308 may have angled teeth, and the teeth of the slips 317 are angled in an opposite direction. Thus, when the buttons 308 are pressed outward, the combination of the slips 317 and the buttons 308 may prevent an upward force from below the packer 300 dislodging the packer 300 from its set position.

Drag blocks 320 may be positioned below the slips assembly 316 and around the packer mandrel 312. The drag blocks 320 are configured to bear against the surrounding tubular, so as to provide friction therewith that resists movement and permits the packer mandrel 312 to be moved relative thereto. Further, a control body 322 may be positioned below and coupled to (e.g., secured in position relative to) the drag blocks 320. A J-pin retainer 323 may be secured to a lower end of the control body 322.

Figure 7A:
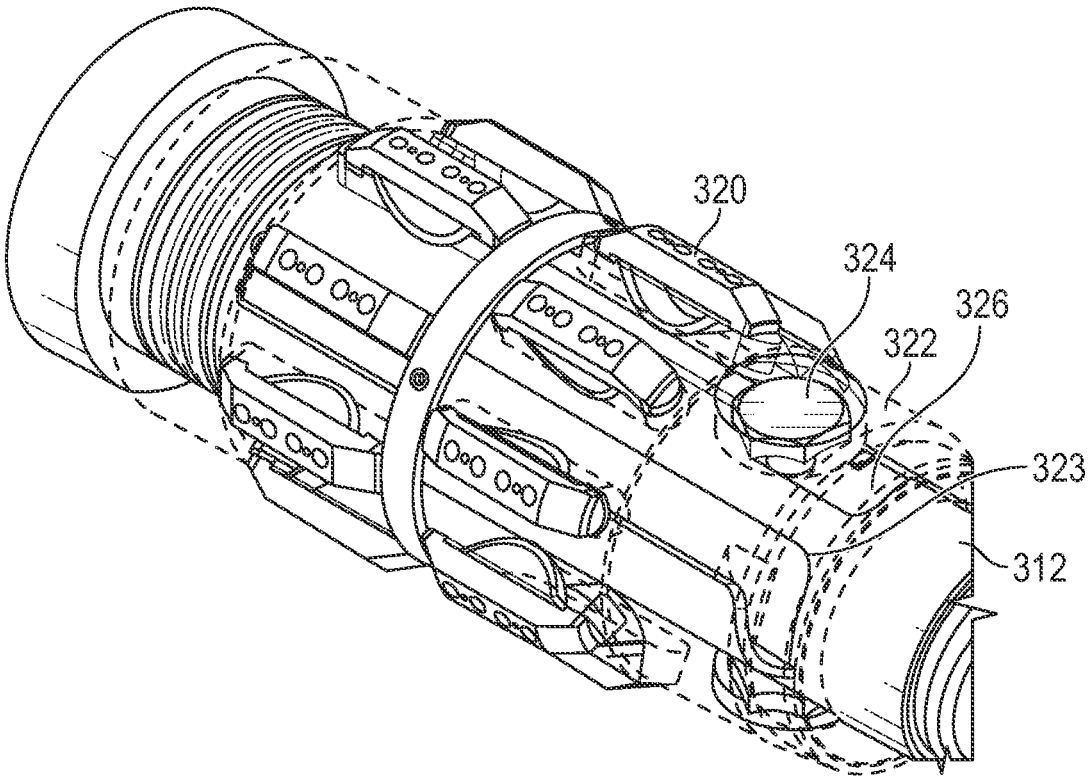
FIG. 7A illustrates a perspective view of a portion of the packer, showing drag blocks and a pin received in a J-slot in a running configuration, according to an embodiment.
Figure 7B:
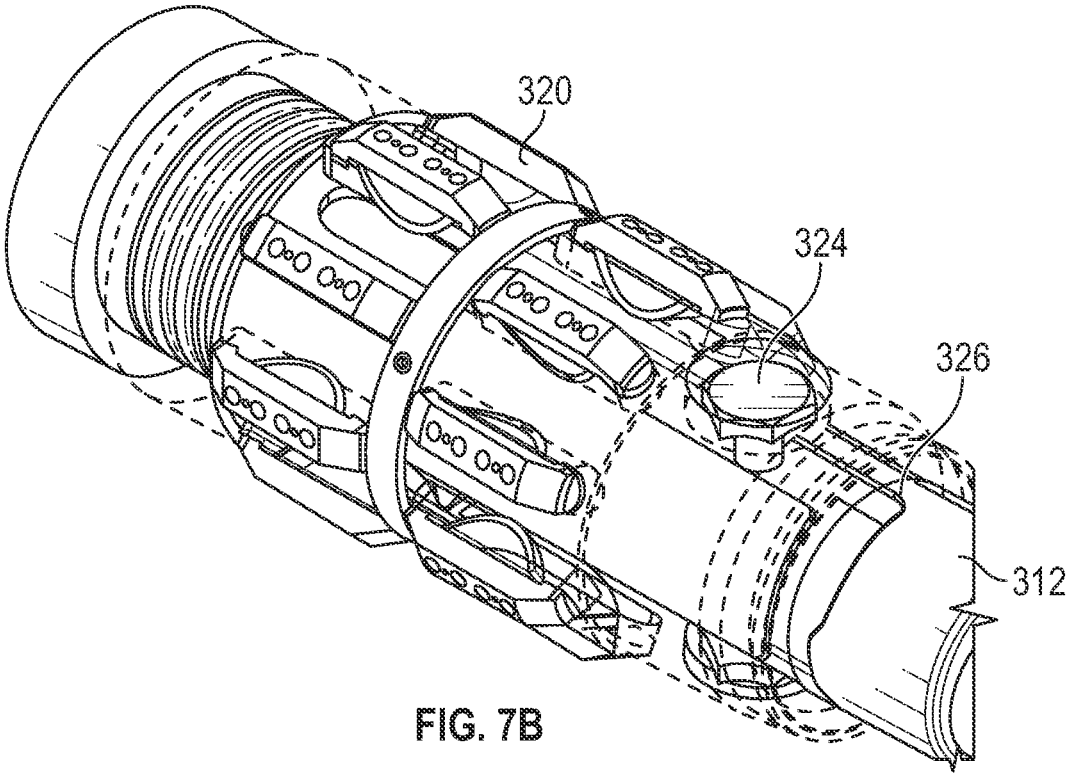
FIG. 7B illustrates a perspective view of the same portion of the packer as FIG. 7A, but with the pin moved in the J-slot to a set configuration, according to an embodiment.

The control body 322 and the J-pin retainer 323 may thus be movable relative to the packer mandrel 312, e.g., to set the packer 300. For example, FIG. 7A illustrates the control body 322 and the J-pin retainer 323 as transparent and positioned around the packer mandrel 312. As shown, the control body 322 and the J-pin retainer 323 receive a pin 324 therethrough, which is also received into a J-slot 326 formed in the packer mandrel 312. In the packer running position, the pin 324 is positioned in the circumferentially-extending portion of the J-slot 326, such that the control body 322 and the J-pin retainer 323 are prevented from sliding axially relative to the packer mandrel 312. Thus, to actuate the packer 300 into the packer set position, the packer mandrel 312 is first rotated relative to the control body 322 and J-pin retainer 323, with the drag blocks 320 serving to resist the rotation of the control body 322 with the packer mandrel 312. This positions the pin 324 in the axially-extending portion of the J-slot 326. The packer mandrel 312 may then be lowered axially downward relative to the control body 322 and J-pin retainer 323, as shown in FIG. 7B, again with the drag blocks 320 initially resisting downward movement of the control body 322 and J-pin retainer 323. This transmits an axially-compressive force upward to the slips assembly 316, which reacts by extending its slips 317 radially outwards. Once the slips 317 establish radial gripping engagement with the wellbore, the weight of tubulars suspended beneath the lower sub (lower sub needs an identification no. in FIG. 6) of the packer pulls downward on the hold down mandrel 306. Downward movement of the packer mandrel 306 relative to the slip assembly 316 applies axial compressive loading to seals 314, which are as a result expanded radially outwards. The combination of the expansion of the seals 314 and pressing the slips 317 radially outwards seals and anchors the packer 300 in place.

Figure 8:
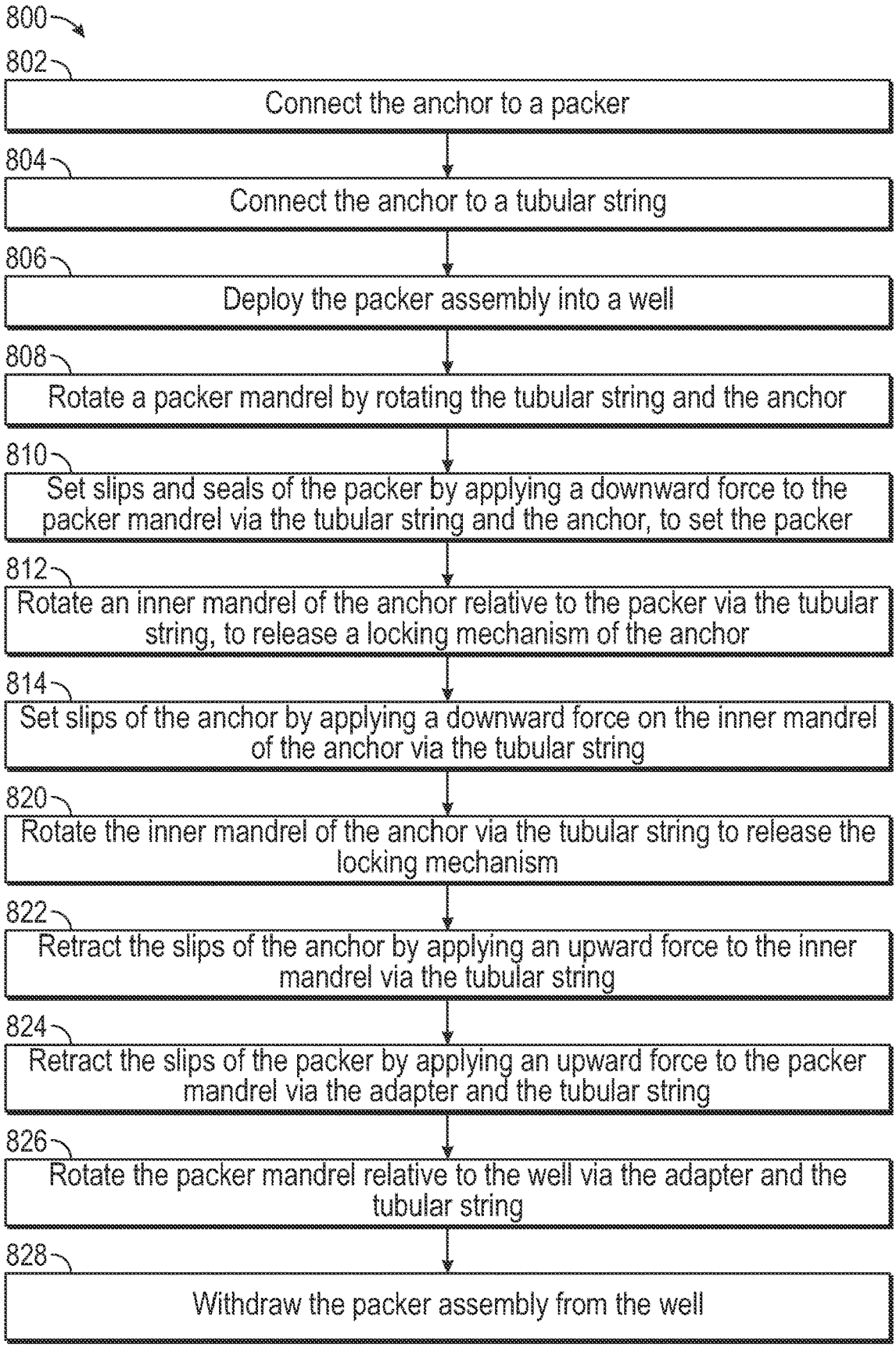
FIG. 8 illustrates a flowchart of a method for setting a packer in a well, according to an embodiment.

Combined operation of the anchor 200 and the packer 300 can be understood in view of the foregoing description of the components and the following discussion. In particular, FIG. 8 illustrates a flowchart of a method 800 for setting the anchor-packer assembly 100 in a well, according to an embodiment. With continuing reference to FIG. 8, and beginning with FIG. 1, the anchor 200 and the packer 300 may initially be in the anchor and packer running positions, respectively, with the slips thereof retracted.

The method 800 may include connecting the anchor 200 to the packer 300, as at 802. The anchor 200 may, for example, be connected to the top of the packer 300 by threading the lower connection 220 into the upper connection 304 of the packer 300, such that a tubular string that runs the assembly 100 into the well is connected to the anchor 200 and not directly to the packer 300. In some embodiments, the packer 300 may be configured to be connected at its lower end to a tailpipe, but may not be connected to such tailpipe. In other embodiments, a tailpipe may be present. The anchor 200 may then be connected to a tubular string, as at 804, and the anchor-packer assembly 100 may be deployed ("run") into a well, as at 806. Eventually the anchor-packer assembly 100 may reach a location where the anchor-packer assembly 100 is to be set.

Referring to FIGS. 2 and 3, in the anchor running position of the anchor 200, the setting control assembly 222 is initially in a first locked condition. In the first locked condition, as illustrated, the upper lock ring 232 is in engagement with the upper threads 250. As can be seen in FIG. 2, this locked condition secures the inner mandrel 202 to the upper lock ring 232. Referring again to FIG. 2, because the upper lock ring 232 is entrained axially between the clutch connector 230 and the cone connector 234, the weight of the cone connector 234, clutch connector 230, torque mandrel 224, lower sub 218, and the packer 300 below are suspended via the upper threads 250, any downward directed forces on the inner mandrel 202 are transmitted to the upper lock ring via threads 250, then the clutch connector 230, the clutch cover 248, the torque mandrel 224, the lower sub 218 and to the packer 300.

As noted above and shown in FIGS. 6 and 7A, the packer mandrel 312, connected to and movable with the lower sub 218 is initially constrained from movement relative to its slips assembly 316 and seals 314 by the pin 324 in the circumferentially-extending section of the J-slot 326. The packer running position thus prevents the packer 300 from being set during downhole deployment.

Upon the anchor-packer assembly 100 reaching the desired setting location, the method 800 may include rotating the packer mandrel 312 by rotating the tubular string and the anchor 200 through transmission of a first torque, as at 808. This first torque received at the anchor 200 from the tubular string is transmitted through the inner mandrel 202 to the clutch 240. The lower sub 218 is able to rotate along with the inner mandrel 202 by torque transmission through the clutch 240. The drag blocks 320 of the packer 300 resist this rotation, but do not react a torque greater than the predetermined torque setting of the clutch 240. Accordingly, the lower sub 218, and thus the packer mandrel 312 rotate relative to the control body 322, thereby moving the pin 324 into the axially-extending portion of the J-slot 326.

Next, as at 810, the slips 317 and seals 314 of the packer 300 are set by applying a downward force (weight) to the anchor 200 via the tubular string, e.g., a "first" axial force. The downward force is applied to the inner mandrel 202 via the upper sub 204. As noted above, the locking mechanism is in the first locked condition, with the upper lock ring 232 transmitting downward axial force from the inner mandrel 202 to the clutch connector 230, the torque mandrel 224 and the lower sub 218. Thus, this downward axial force is transmitted to the packer mandrel 312. The drag blocks 320 resist the axial movement, and as a result, the packer mandrel 312 moves downward relative to the control body 322, thereby moving the pin 324 in the axially-extending portion of the J-slot 326, and expanding the slips assembly 316 and the seals 314. The packer 300 is now set (i.e., actuated into the packer set position).

The packer 300 however, as mentioned above, may be a storm packer, and thus may be designed to stay in the packer set position under downward axial load on its packer mandrel 312 provided by the tailpipe. In the absence of a tailpipe (e.g., when the packer 300 is being used as a retrievable plug and is connected to the anchor 200), the packer 300 may not include any devices that, independently of the anchor 200, are configured to prevent the packer mandrel 312 from rising in the well, e.g., due to a transient pressure differential, and releasing the slips 317. The anchor 200, however, provides this functionality.

At this point, the anchor 200 remains in the anchor running position, with its locking mechanism in the first locked condition. Specifically, the upper lock ring 232 is engaging the upper threads 250 and preventing downward movement of the inner mandrel 202.

Accordingly, the method 800 may include, as at 812, rotating (e.g., a "second" torque) the tubular string so as to rotate the upper portion of the anchor 200 relative to the packer 300. The direction of rotation may remain the same, e.g., right-handed, so as to preserve integrity of the threaded connections in the tubular string and in the anchor-packer assembly 100. This second torque is applied to the upper sub 204 of the anchor 200, and is transmitted to the inner mandrel 202. The packer 300, which is set as noted above and has its pin 324 is in the axially-extending portion of the J-slot 326, thus resists rotation relative to the wellbore. The torque applied to the inner mandrel 202 is applied to the upper clutch jaw 242 of the clutch 240, but the lower clutch jaw 244 is rotationally locked to the lower sub 218 and thus the packer mandrel 312, which is prevented from rotating because the packer 300 is set. Once the torque applied to the inner mandrel 202 reaches the predetermined torque setting of the clutch 240, the upper clutch jaw 242 rotates relative to the lower clutch jaw 244, permitting the inner mandrel 202 to rotate relative to the upper lock ring 232 in the first rotational direction. Continued rotation results in the upper threads 250 becoming unmeshed from the threads 266 of the upper lock ring 232, which unlocks or "releases" the locking mechanism of the anchor 200. In other words, the anchor 200 is now in the unlocked condition, as the inner mandrel 202 may be permitted to move axially downward from its position in the anchor set position.

The method 800 may then include setting the slips 212 of the anchor 200 by lowering the inner mandrel 202 axially in the first axial direction (downhole), e.g., by moving the tubular string in the first axial (downhole) direction (e.g., via application of a "second" axial force), as at 814. The upper cone 208 may not be axially movable with respect to the inner mandrel 202, and thus is also moved downward. In contrast, the slips 212 and lower cone 210 may be axially stationary relative to the lower sub 218. Thus, moving the inner mandrel 202 in a downhole direction moves the upper cone 208 toward the lower cone 210 and drives the slips 212 radially outward and into engagement with (e.g., so as to partially embed or "bite into") the surrounding tubular.

This axial movement of the inner mandrel 202 may also move the locking mechanism into a second locked condition, i.e., the axial movement "locks" the previously unlocked/released locking mechanism. In particular, as shown in FIG. 3, the lower lock ring 226 may be brought into engagement with the lower threads 252 of the inner mandrel 202. As shown in FIG. 4B, the orientation of the threads 252, 268 prevents reverse axial sliding movement of the inner mandrel 202 in the second axial direction (uphole, to the left in this view) relative to the lower lock ring 226, while the pressure of the slips 212 against the surrounding tubular prevents the inner mandrel 202 from moving farther in the first axial direction (downhole, to the right in this view). The anchor 200 is thus locked in its anchor set position.

With the mandrel 202 locked in place relative to the lower sub 218, the packer 300 is thus likewise locked in its packer set configuration. That is, the packer mandrel 312 is at least axially fixed in position relative to the lower sub 218 of the anchor 200. The lower sub 218 is prevented from moving axially in the uphole direction, because it is axially engaged with the slips assembly 207. To permit the lower sub 218 to move in an uphole direction, the slips assembly 207 either needs to compress or release. However, compressing the slips assembly 207 would cause the slips 212 to move outward, and the slips 212 are already engaging the surrounding tubular and thus cannot move outward. Moving the inner mandrel 202 in the uphole direction relative to the lower sub 218, which would retract the slips 212, is prevented by the lower lock ring 226 engaging the threads 252 of the inner mandrel 202. Thus, the lower sub 218 is locked in axial position by the slips assembly 207, thereby locking the packer 300 in its packer set configuration. Once the packer is set in the wellbore the landing string may be disconnected and retrieved from the wellbore. The packer 300 and anchor assembly 200 may then be considered set and the well therefore plugged. The packer 300 may retain its position in the well indefinitely. This is accomplished, as described above, through selective rotation and axial movement of the anchor 200 and/or packer 300.

At some point, it may be desired to retrieve the packer 300 from the well. Thus, the method 800 may include selectively rotating the inner mandrel 202, e.g., using the tubular string connected to the upper sub 204 of the anchor 200, so as to release the locking mechanism, as at 820. This rotation may continue to be in the same, right-hand orientation. Since the packer 300 is still set and resisting rotation, the clutch 240 permits the inner mandrel 202 to rotate relative to the lower sub 218, and thus relative to the lower lock ring 226. The rotation of the inner mandrel 202 may advance the threads 252 progressively out of engagement with the lower lock ring 226, and the mandrel 202 may be rotated until the threads 252 are fully disengaged from the lower lock ring 226. This unlocks (releases) the locking mechanism from its second locked condition.

The slips 212 may then be retracted, as at 822, by selectively moving/sliding the inner mandrel 202 and upper sub 204 axially in the second axial direction (uphole), which may permit the upper cone 208 to move away from the lower cone 210. The threads 250 of the inner mandrel 202 may be moved axially into engagement with the threads 266 of the upper lock ring 232, which permit such uphole movement but resist axial sliding movement of the inner mandrel 202 in the first axial (downhole) direction relative to the lower sub 218. Thus, the locking mechanism is once again locked, this time back in the first locked condition, and the anchor 200 is back in the anchor running position.

The method 800 may then include retracting the slips 317 and seals 314 of the packer 300 by selectively applying an upward force in the second axial direction (uphole) to the anchor 200, as at 824. This force is transmitted to the lower sub 218 via the inner mandrel 202, and the threads 250 thereof in connection with the upper lock ring 232. Since the anchor 200 is in the anchor running configuration, and is not anchored in place against the surrounding tubular, the force on the lower sub 218 is applied to the packer mandrel 312. The packer mandrel 312 thus moves relative to the pin 324, such that the pin 324 is moved back into the circumferentially-extending portion of the J-slot 326. This also retracts the slips 317 and permits the seals 314 to resiliently retract radially inward. The packer 300 is thus unset, although the drag blocks 320 still engage the surrounding tubular.

The method 800 then includes selectively rotating the packer mandrel 312 by selectively rotating the upper sub 204 of the anchor 200, as at 826. Because the packer 300 is no longer set, the resistance to rotation between the inner mandrel 202 and the lower sub 218 may not exceed the predetermined torque setting of the clutch 240. As a result, the rotation is transferred to the packer mandrel 312, which moves the pin 324 in the circumferentially-extending portion of the J-slot 326, back to its original position. The packer 300 is now back in the packer running position, and, because the anchor 200 has already been returned to the anchor running position, the assembly 100 may be removed from the well, e.g., by moving the anchor-packer assembly 100 in the second axial direction (uphole), as at 828.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An anchor-packer assembly, comprising:

a packer having a slips assembly and a seal, wherein the slips assembly and the seal are radially expandable so as to engage a surrounding tubular; and an anchor coupled to the packer, wherein the anchor comprises a slips assembly and is configured to transmit a first torque and a first axial force to the packer, to set the packer, wherein the anchor is configured to be actuated from an anchor running position in which the slips assembly thereof is retracted, to an anchor set position, in which the slips assembly thereof is expanded radially outward, in response to a second torque and a second axial force, and wherein the anchor in the anchor set position is configured to prevent an uphole-directed force on the packer from releasing the slips assembly of the packer from engagement with the surrounding tubular.

2. The anchor-packer assembly of claim 1, wherein the packer is configured to connect to a tailpipe but is not connected to the tailpipe when the packer is connected to the anchor, and wherein the anchor is free from sealing elements.

3. The anchor-packer assembly of claim 1, wherein the anchor comprises an inner mandrel, and wherein the slips assembly of the anchor and the slips assembly of the packer are both configured to be set in the surrounding tubular by selectively rotating the inner mandrel in a right-hand rotational direction and selectively moving the inner mandrel of the anchor a first axial direction.

4. The anchor-packer assembly of claim 1, wherein:

the packer comprises an upper sub, a packer mandrel and a control body, wherein the packer mandrel is actuated from a packer running position to a packer set position by rotating the upper sub and packer mandrel relative to the control body and then moving the upper sub and packer mandrel in a first axial direction relative to the control body; and the anchor comprises an inner mandrel, a torque mandrel positioned around the inner mandrel and coupled to the packer mandrel so as to be rotatable and axially movable only along with the packer mandrel, and a setting control assembly coupled to the inner mandrel and the torque mandrel, the setting control assembly comprising:

a clutch configured to selectively permit or prevent the inner mandrel to rotate relative to the torque mandrel depending on whether the packer is in the packer set position or the packer running position; and a locking mechanism configured to selectively permit the inner mandrel to move in a first axial direction or a second axial direction relative to the torque mandrel.

5. The anchor-packer assembly of claim 4, wherein the packer further comprises drag blocks coupled to the control body, the drag blocks being configured to engage the surrounding tubular so as to permit the packer mandrel to move relative to the control body in response to movement of the torque mandrel of the anchor and upper sub of the packer.

6. The anchor-packer assembly of claim 4, wherein the packer comprises a J-slot formed in the packer mandrel, and a pin received into the J-slot and through the control body.

7. The anchor-packer assembly of claim 4, wherein the clutch transmits torque between the inner mandrel and the torque mandrel up to a predetermined amount of torque, and permits rotation of the inner mandrel relative to the torque mandrel by application of a torque that exceeds the predetermined amount of torque.

8. The anchor-packer assembly of claim 7, wherein, when the packer is in the packer running position, the packer mandrel is configured to rotate relative to the control body by application of a torque to the packer mandrel that is below the predetermined amount of torque, and wherein, when the packer is in the packer set position, the packer mandrel is not rotatable relative to the control body by application of less than or equal to the predetermined amount of torque.

9. The anchor-packer assembly of claim 4, wherein the locking mechanism has a first locked condition and an unlocked condition, wherein, in the first locked condition, the locking mechanism prevents the inner mandrel from sliding relative to the torque mandrel in at least the first axial direction, and wherein, in the unlocked condition, the inner mandrel is slidable in the first axial direction relative to the torque mandrel.

10. The anchor-packer assembly of claim 9, wherein the locking mechanism is actuated from the first locked condition to the unlocked condition by rotating the inner mandrel relative to the torque mandrel.

11. The anchor-packer assembly of claim 10, wherein the locking mechanism includes a second locked condition, wherein the locking mechanism is actuated from the unlocked condition to the second locked condition by sliding the inner mandrel axially with respect to the torque mandrel in the first axial direction, and wherein the locking mechanism in the second locked condition prevents the inner mandrel from sliding in a second axial direction relative to the torque mandrel, wherein moving the inner mandrel in the first axial direction extends the slips assembly of the anchor radially outward, and the locking mechanism in the second locked condition prevents the slips assembly of the anchor from retracting.

12. An anchor for a storm packer, the anchor comprising:

a torque mandrel configured to connect to a packer mandrel of the storm packer and configured to transmit torque and axial forces thereto;

an inner mandrel positioned at least partially within the torque mandrel;

a clutch coupled to the inner mandrel and the torque mandrel, wherein the clutch is configured to transmit torque between the inner mandrel and the torque mandrel up to a predetermined amount of torque, and to permit relative rotation therebetween at a torque above the predetermined amount of torque, wherein the storm packer in a running position is rotatable by rotating the torque mandrel in a first rotational direction;

a slips assembly positioned around the inner mandrel and extendable radially outward by moving the inner mandrel in a first axial direction relative to the torque mandrel; and a locking mechanism to selectively couple the torque mandrel to the inner mandrel, the locking mechanism having:

a first locked condition that permits the inner mandrel to rotate relative to the torque mandrel, and prevents the inner mandrel from moving in a first axial direction relative to the torque mandrel;

an unlocked condition that permits the inner mandrel to move in the first axial direction and a second axial direction relative to the torque mandrel so as to extend and retract the slips assembly; and a second locked condition that permits the inner mandrel to rotate relative to the torque mandrel, and prevents the inner mandrel from moving in the second axial direction relative to the torque mandrel; and wherein the locking mechanism is configured to be actuated from the first locked condition to the unlocked condition by rotating the inner mandrel in the first rotational direction relative to the torque mandrel at a torque that is above the predetermined amount of torque.

13. The anchor of claim 12, further comprising a lower sub coupled to the torque mandrel, wherein the lower sub is configured to be connected to an upper sub of the storm packer, the upper sub of the storm packer being connected to the packer mandrel, such that the torque and axial forces are transmitted from the torque mandrel to the packer mandrel via the lower sub of the anchor and the upper sub of the storm packer.

14. The anchor of claim 12, wherein the locking mechanism in the first locked condition is configured to cause the inner mandrel to transmit an axial force in the first axial direction to the packer mandrel, so as to set the storm packer, and wherein the locking mechanism in the second locked condition is configured to prevent the inner mandrel from sliding in the second axial direction, such that the slips assembly is prevented from retracting.

15. The anchor of claim 14, the locking mechanism is actuated from the unlocked condition to the second locked condition by sliding the inner mandrel relative to the torque mandrel in the first axial direction, wherein sliding the inner mandrel relative to the torque mandrel in the first axial direction causes the slips assembly to extend radially outward, and wherein the locking mechanism is actuated from the second locked condition to the unlocked condition by rotating the inner mandrel in the first rotational direction.

16. The anchor of claim 12, wherein the clutch comprises an upper clutch jaw rotationally secured to the inner mandrel, a lower clutch jaw rotationally secured to the torque mandrel, and a spring that biases the upper and lower clutch jaws together.

17. A method for setting a packer, comprising:

connecting an anchor to the packer so as to form at least a portion of a packer assembly;

deploying the packer assembly into a well;

rotating a packer mandrel of the packer in a first rotational direction by rotating an inner mandrel of the anchor in the first rotational direction;

after rotating the packer mandrel, setting slips of the packer in a surrounding tubular by moving the anchor in a first axial direction;

after setting the packer, rotating the inner mandrel relative to a torque mandrel of the anchor to release a locking mechanism, the torque mandrel being prevented from rotating along with the inner mandrel by connection to the packer mandrel; and after rotating the inner mandrel, setting slips of the anchor by moving the inner mandrel in the first axial direction relative to the torque mandrel, wherein moving the inner mandrel in the first axial direction locks the locking mechanism, such that the torque mandrel is prevented from moving in a second axial direction relative to the inner mandrel, and wherein the inner mandrel is prevented from moving in the second axial direction by the slips of the anchor.

18. The method of claim 17, further comprising:

rotating the inner mandrel in the first rotational direction relative to the torque mandrel to release the locking mechanism;

after rotating the inner mandrel to release the locking mechanism, moving the inner mandrel in the second axial direction relative to the torque mandrel so as to retract the slips of the anchor, wherein moving the inner mandrel in the second axial direction locks the locking mechanism;

after retracting the slips of the anchor, rotating the inner mandrel and the torque mandrel so as to rotate the packer mandrel in a second rotational direction;

after rotating the packer mandrel in the second rotational direction, retracting the slips of the packer by moving the inner mandrel and the torque mandrel in the second axial direction; and withdrawing the packer assembly from the well in the second axial direction.

19. The method of claim 17, wherein the anchor comprises a clutch that is coupled to the inner mandrel and the torque mandrel, wherein the clutch permits the inner mandrel to rotate relative to the torque mandrel when the slips of the packer are engaged with the surrounding tubular, and wherein the clutch transmits rotation of the inner mandrel to the torque mandrel and the packer mandrel when the slips of the packer are retracted.

20. The method of claim 17, wherein the anchor comprises a locking mechanism having a first locked condition, a second locked condition, and an unlocked condition, wherein the locking mechanism in the first locked condition is configured to transmit an axial force in the first axial direction from the inner mandrel to the torque mandrel and the packer mandrel, so as to expand the slips of the packer, and wherein the locking mechanism in the second locked condition is configured prevent the inner mandrel from moving in the second axial direction relative to the torque mandrel, so as to prevent the slips of the packer from retracting.

* * * * *